United States Patent [19]

Massok, Jr. et al.

[11] 4,186,499

[45] Feb. 5, 1980

[54] CONSTRUCTION FOR ABSORBING ODORS CAUSED BY PERSPIRATION AND METHOD OF MAKING SAME

[75] Inventors: Anthony J. Massok, Jr., Richmond; James P. Nolan, Chester, both of Va.

[73] Assignee: Dayco Corporation, Dayton, Ohio

[21] Appl. No.: 908,047

[22] Filed: May 22, 1978

[51] Int. Cl.[2] ..... A43B 13/38; A43B 13/40

[52] U.S. Cl. ..... 36/44; 2/239; 139/420 R; 428/248

[58] Field of Search ..... 36/43, 44; 2/239; 139/420 R, 426 R, 420; 423/447.1, 447.2; 264/211; 428/248

[56] References Cited

U.S. PATENT DOCUMENTS

| | | | |
|---|---|---|---|
| Re. 4,547 | 9/1871 | Johnson . | |
| Re. 29,501 | 12/1977 | Lapidus . | |
| 795,562 | 7/1905 | Tatti . | |
| 1,144,291 | 6/1915 | Boyer . | |
| 2,003,961 | 6/1935 | Vittengl . | |
| 2,061,911 | 11/1936 | Leindorf . | |
| 2,748,502 | 6/1956 | Scholl . | |
| 2,752,279 | 6/1956 | Alderfer . | |
| 3,007,083 | 10/1961 | MacQuaid, Jr. et al. . | |
| 3,007,205 | 11/1961 | House . | |
| 3,143,812 | 8/1964 | Bittner . | |
| 3,449,844 | 6/1969 | Spence | 36/44 |
| 3,607,672 | 9/1971 | Schmitt | 423/447.2 |
| 3,640,920 | 2/1972 | Cear . | |
| 3,735,511 | 5/1973 | Gilbert et al. . | |
| 3,744,534 | 7/1973 | Henry et al. | 139/426 R |
| 3,842,519 | 10/1974 | Lapidus . | |
| 3,850,785 | 11/1974 | McQuade et al. | 428/248 |
| 3,852,897 | 12/1974 | Bridge et al. . | |
| 4,062,131 | 12/1977 | Hsiung | 36/44 |

FOREIGN PATENT DOCUMENTS

| | | | |
|---|---|---|---|
| 50-104256 | 8/1975 | Japan | 264/211 |

OTHER PUBLICATIONS

Fabric Development Inc., Development and Production of Specialized Fabrics for Aerospace and Industrial Uses.

*Primary Examiner*—James Kee Chi
*Attorney, Agent, or Firm*—Charles E. Bricker

[57] ABSTRACT

A construction for absorbing odors caused by perspiration and method of making same are provided wherein such construction comprises a fabric having at least one member comprising an exposed surface thereof with the member comprising an odor-absorbing material and with the member being freely accessible on the exposed surface to the perspiration thereby assuring unimpeded action by the odor-absorbing material thereof.

19 Claims, 10 Drawing Figures

CONSTRUCTION FOR ABSORBING ODORS CAUSED BY PERSPIRATION AND METHOD OF MAKING SAME

BACKGROUND OF THE INVENTION

Various constructions and methods of making same have been proposed heretofore for absorbing odors caused by perspiration. For example U.S. Pat. No. 795,562 teaches the provision of a layer of a powder material which includes charcoal powder, sandwiched between confining sheets or fabrics to define a construction usable as a dress shield or insole for a shoe. U.S. Pat. No. 3,842,519 and Re.29,501 disclose shoe inserts for absorbing odors wherein each insert has activated charcoal particles embedded in a so-called open-celled latex foam which serves as a matrix therefor. U.S. Pat. No. 3,852,897 discloses a so-called insock for insertion into a shoe and wherein the insock comprises a fibrous web or mat loaded with active carbon and a special binder disposed adjacent the surface of the web or mat. U.S. Pat. No. 4,062,131 discloses an insole for footwear comprised of a multilayer laminate which employs an intermediate porous sheet of randomly disposed fibers impregnated with a foot-odor absorbing chemical.

However, each of these previously proposed constructions is basically deficient in that the odor absorbing material comprising same is not freely accessible so that it is free to act. Another deficiency of each of these previously proposed constructions is the necessity in each instance to provide additional structural components to support the odor-absorbing material so that it may perform its function.

SUMMARY

It is a feature of this invention to provide a construction for absorbing odors caused by perspiration and method of making the same wherein such construction overcomes the above-mentioned deficiencies.

Another feature of this invention is to provide a construction of the character mentioned which comprises a fabric having at least one member comprising the exposed surface thereof with the member comprising an odor-absorbing material and with the member being freely accessible on the exposed surface to the perspiration thereby assuring unimpeded action by the odor-absorbing material thereof.

Another feature of this invention is to provide a construction of the character mentioned wherein the member having the odor-absorbing material provided as a part thereof or defining the entire member is what may be considered a load-carrying or structural member of the fabric.

Another feature of this invention is to provide a construction of the character mentioned which further comprises cushion means fixed to the fabric portion thereof.

Another feature of this invention is to provide a construction of the character mentioned in the form of an article of clothing.

Another feature of this invention is to provide a construction of the character mentioned in the form of a shoe insole.

Another feature of this invention is to provide an improved method of making a construction for absorbing odors caused by perspiration.

Therefore, it is an object of this invention to provide an improved construction for absorbing odors caused by perspiration, and method of making same, having one or more of the novel features set forth above or hereinafter shown or described.

Other details, features, uses, objects, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
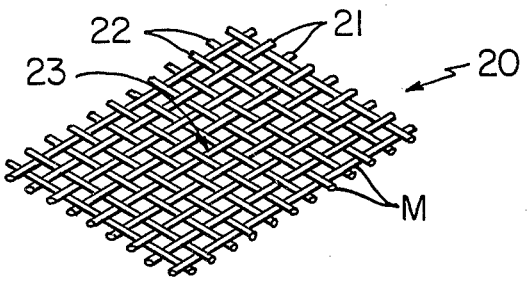
FIG. 1 is a fragmentary perspective view illustrating one exemplary embodiment of the construction of this invention in the form of a woven fabric having parallel warps and parallel wefts disposed transverse the wefts.
Figure 2:
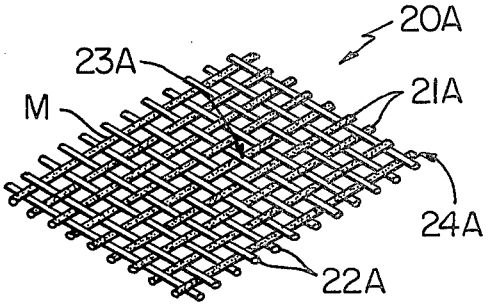
FIG. 2 is a fragmentary perspective view illustrating another exemplary embodiment of the construction of this invention which is a modification of the woven fabric of FIG. 1.

Reference is now made to FIG. 1 of the drawings which illustrates one exemplary embodiment of a construction for absorbing odors caused by perspiration and such construction is in the form of a fabric which is designated generally by the reference numeral 20. The fabric 20, modifications thereof, and other exemplary embodiments of fabric which will be described hereinafter may be made to comprise or completely define various articles of clothing such as socks, underarm pads, and undergarments of all types—especially undergarments which are worn in intimate contact with the wearer's skin. In addition, the fabric 20 modifications thereof, and various types of fabric to be subsequently described may define or comprise an insole for a shoe particularly adapted to absorb odors caused by perspiration from perspiring feet.

The fabric 20 is comprised of a plurality of members each designated by the same reference letter M and the members M in this example define the entire fabric 20 and are the structural or load-carrying members thereof. In particular, the members M are in the form of spaced parallel warps 21 which are woven as is known in the art with spaced parallel wefts 22 disposed transverse thereto to define the fabric 20. In this example the wefts 22 are disposed substantially perpendicular to the warps 21 to define the fabric as a square woven fabric. Further, the members M defining warps and wefts 21 and 22 respectively comprise and in this example completely define exposed surface 23 of the fabric 20.

Each of the members M, and hence each member 21–22, is comprised of an odor-absorbing material which may be provided as an integral part of each member M and preferably disposed in a homogeneous manner throughout as will be described in detail subsequently or the entire member may be made of such odor-absorbing material and as will also be described subsequently. Although any suitable material known in the art may be employed for this purpose, such material is preferably in the form of a carbonaceous material such as a suitable activated carbon which is active in absorbing perspiration odors.

Other exemplary embodiments of constructions, shown in the form of exemplary fabrics, of this invention are illustrated in FIGS. 2, 3, 4, 5, 6, and 7 of the drawings. The fabric constructions illustrated in FIGS. 2, 3, 4, 5, 6, and 7 are similar to the construction or fabric 20; therefore, such constructions will be designated by the reference numerals 20A, 20B, 20C, 20D, 20E and 20F respectively and representative parts of each fabric which are similar to corresponding parts of the fabric 20 will be designated in the drawings by the same reference numeral as in the fabric 20 followed by an associated letter designation and not described again in detail. Only those component parts of each fabric which are different from corresponding parts of the fabric 20 will be designated by new reference numerals also followed by the associated letter designation and described in detail. Further, each of the fabric constructions now to be described is comprised of one or more members that either has odor-absorbing material provided as an integral part thereof (and preferably substantially homogeneously throughout) or defines the entire member and in each instance one or more members will also be designated by the reference numeral M for ease of understanding and presentation of this invention.

The fabric 20A is also comprised of warps 21A and wefts 22A wherein only the warps 21A thereof are in the form of members M which comprise the previously described odor-absorbing material and each of such warps is indicated at 24A by stippling as shown, for example. Each member M defining each warp 21A may be comprised of the previously described odor-absorbing material or the entire warp 21A may be made of such odor-absorbing material and, each member M is freely accessible on the exposed surface 23A of fabric 20A.

Figure 3:
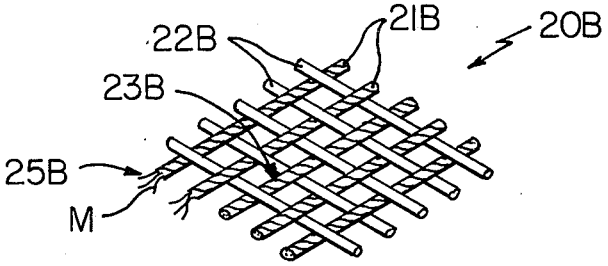
FIG. 3 is a fragmentary perspective view illustrating another exemplary embodiment of the construction of this invention which is another modification of the woven fabric of FIG. 1.

The fabric 20B of FIG. 3 is also in the form of a woven fabric having warps 21B and wefts 22B. Each warp 21B is comprised of a plurality of strands or filaments, as indicated at 25B, which may be in the form of twisted filaments; and, the filaments of each warp 21B have at least one member M associated therewith which is freely accessible on the exposed surface 23B of fabric 20B. It will also be appreciated that the filaments defining each warp 21B need not necessarily be twisted but may be untwisted.

Figure 4:
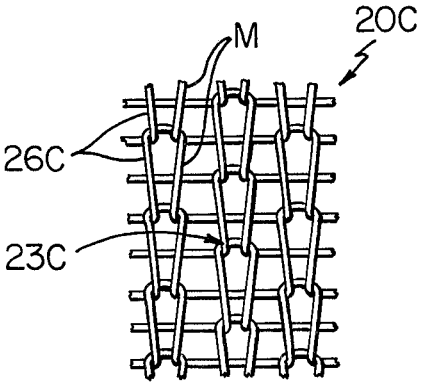
FIG. 4 is a fragmentary plan view illustrating another exemplary embodiment of the construction of this invention in the form of a knitted fabric.

The fabric 20C of FIG. 4 is comprised of one or more knitted members M each of which is also designated by the reference numeral 26C. Each member M, as previously described, comprises an odor absorbing material or the entire member is made of the odor-absorbing material and is freely accessible on the exposed surface 23C thereof.

Figure 5:
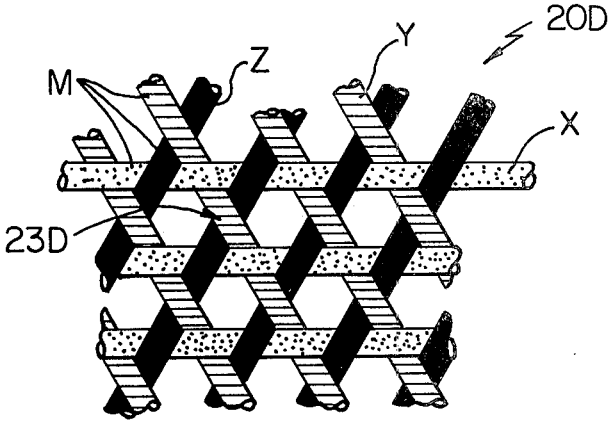
FIG. 5 is a fragmentary plan view illustrating another exemplary embodiment of the construction of this invention in the form of a triaxial fabric.

The fabric 20D illustrated in FIG. 5 is in the form of a triaxial fabric and has a plurality of three sets of yarn courses or yarns M which for ease of presentation are shown as being of equal yarn size and the yarns of each set are disposed in parallel relation. In this example, the yarns of one set, depicted in solid black, will be referred to as the woof or Z yarns; the yarns of a second set, depicted by cross-hatching, will be referred to as weft or Y yarns; and the yarns of the third set, depicted by stippling, will be referred to as the warp or X yarns. Members M define each of the X, Y, and Z yarns, and each is comprised of odor-absorbing material as previously described and each yarn M (X, Y, and Z) is freely accessible on the exposed surface 23D of fabric 20D. It will be appreciated that the particular type of triaxial fabric 20D illustrated in FIG. 5 has been presented for simplicity of illustration; and, it is to be understood that any triaxial fabric known in the art may be defined by a plurality of members M.

Figure 6:
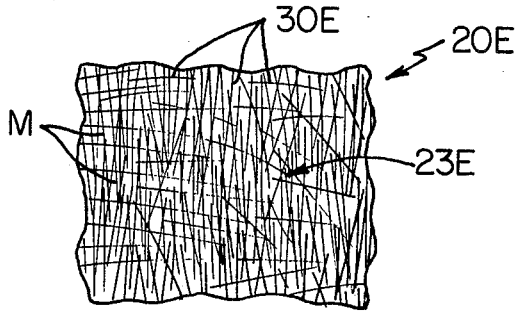
FIG. 6 is a fragmentary plan view illustrating another exemplary embodiment of the construction of this invention in the form of a non-woven fabric.

The fabric 20E of FIG. 6 is a non-woven fabric comprised of a plurality of filament members M which may be straight elongate members M which are also designated 30E and the members are randomly arranged, highly dispersed, and suitably bonded at their filament junctions. The members M may be made in accordance with any technique known in the art to define the non-woven fabric 20E and are dispersed in such a manner to define a sheet-like fabric material having exposed surface 23E which may be air impervious or may have a porosity which is determined essentially by the number, size, and dispersement of members M employed.

It will also be appreciated that instead of the members M of fabric 20E being straight such members may be crimped members which are also randomly arranged, highly dispersed, and suitably bonded at their junctions to define a non-woven sheet-like fabric material having greater pliability.

Figure 7:
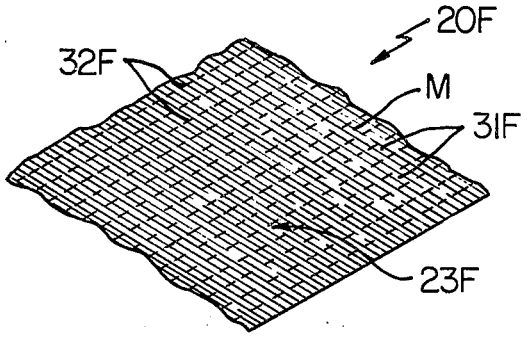
FIG. 7 is a fragmentary plan view illustrating another exemplary embodiment of the construction of this invention in the form of another type of non-woven fabric.

The fabric 20F of FIG. 7 is comprised of a plurality of members 31F defined entirely of members M sufficient in number, size, and arrangement to, in essence, form a mat or mat-like structure. The members 31F are disposed in substantially parallel relation and are held together by suitable stitch means indicated by dotted lines 32F and such stitch means may be in the form of conventional sewing stitches, or the like. The stitch means or stitching 32F may be made of the same filamentary material as the members M or may be made of different material. The stitching 32F is comprised of a plurality of parallel stitches 32F disposed substantially perpendicular to the members M and it will be seen that the fabric 20F has exposed surface 23F. The fabric 20F is often popularly referred to as a stitch bonded fabric and a similar fabric made with ordinary materials (without employing members M as taught by this invention) is sold by the Tietex Corporation of Spartanburg, S.C. 29304.

In each of the fabric constructions 20, 20A, 20B, 20C, 20D, 20E, and 20F described above reference is made to each having a plurality of members M which are described in detail; and, each of the fabrics is referred to as having an exposed surface which is identified and shown as the top surface in the drawing of the fabric. However, it will be appreciated that in the forming of each simple fabric, as shown, the fabric will also have an exposed surface arranged opposite from the top surface which is viewed in each drawing.

It will also be appreciated that in making each member M used in each illustrated fabric any suitable technique known in the art may be used. For example, a technique employed in making of a viscose rayon may be used whereby a viscous solution consisting essentially of cellulose xanthate in sodium hydroxide has activated carbon particles dispersed therethrough in a homogeneous manner so as to, in essence, permeate the entire solution. Such solution is allowed to coagulate (often in a bath containing sulfuric acid) as is known in the art and is extruded through suitable spinnerets or dies to form filaments which define the members M illustrated and described in connection with each of the various embodiments of this invention presented heretofore. Thus, each member M has activated carbon disposed homogeneously throughout and comprising an integral part thereof; however, it is to be understood that the entire member M may be made of a suitable carbonaceous material.

In particular, each member M may be in the form of a structural yarn which has perspiration odor absorbing properties. An example of an ordinary graphite yarn, which it is believed may be suitably modified so that it has perspiration absorbing properties, is manufactured by Union Carbide Corporation, Carbon Products Division, 270 Park Avenue, New York 10017 and sold under the registered trademark "THORNEL". Such ordinary "THORNEL" graphite yarn is sold as Thornel 300 graphite yarn grade WYP30 1/1 and is in the form of a continuous length, high-strength, high-modulus fiber consisting of 3,000 filaments in a one-ply construction.

In the fabrics 20C, 20D, 20E, and 20F practically all of the members defining each fabric have been described as consisting of or being made entirely of odor-absorbing material. However, it is to be understood that only certain ones of the members of these fabrics, or of any fabric, may comprise odor-absorbing material depending on the desired odor-absorbing capacity of the particular fabric.

In addition, regardless of whether one or more members M comprise an entire fabric or only a part of such fabric, each member M is in each instance a load-carrying or structural member of its associated fabric. Further, each member M is freely accessible on the exposed surface of the fabric thereby assuring unimpeded action of the odor absorbing material comprising same.

In constructions 20 and 20A through 20F, the fabric itself in each instance basically defines the entire construction for absorbing odors caused by perspiration; however, it will appreciated that such fabric may be the component part of the overall construction which is used to absorb odors caused by perspiration as will be apparent from the following description.

Figure 8:
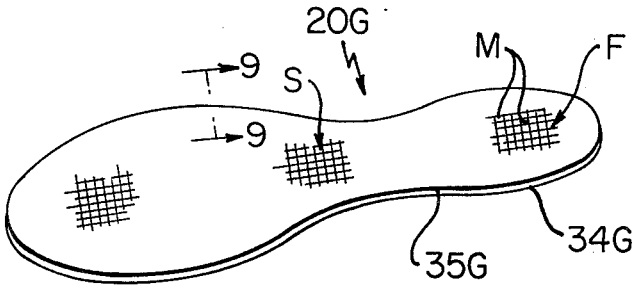
FIG. 8 is a perspective view of a construction for absorbing odors caused by perspiration in the form of an insole.
Figure 9:
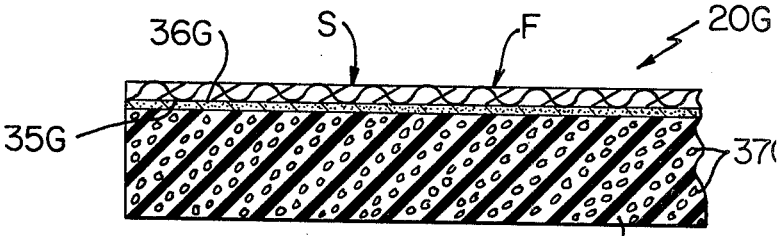
FIG. 9 is an enlarged cross-sectional view taken essentially on the line 9—9 of FIG. 8.

For example, reference is now made to FIGS. 8 and 9 of the drawings which illustrate a construction in the form of a shoe insole which is designated generally by the reference numeral 20G and is capable of absorbing odors caused by perspiration from perspiring feet. The insole 20G has a top or upper fabric portion which is designated in FIGS. 8 and 9 of the drawings by the reference letter F and is comprised of at least one member M which comprises the top exposed surface thereof which is designated by the reference letter S. Each of the one or more members M of fabric F is freely accessible to foot perspiration thereby assuring unimpeded action by the odor absorbing material thereof.

This designation of the fabric portion of insole 20G with the letter F is done for ease of presentation and it is to be understood that such fabric F may be any one of the fabrics described in detail previously such as the fabrics 20, 20A, 20B, 20C, 20D, 20E, and 20F, and modifications of such fabrics as described in this disclosure.

The insole construction 20G also has a substrate in the form of cushion of cushion means 34G made of a compressible polymeric material fixed against the fabric F on the surface 35G thereof opposite from the exposed top surface S. The cushion means 34G is preferably fixed to the fabric F by adhesive means in the form of adhesive 36G.

The cushion means 34G is preferably in the form of a compressible yet resilient polymeric cushion or pad having air spaces 37G disposed substantially uniformly throughout. The pad 34G is preferably made of a rubber latex foam and such latex foam is preferably in the form of a styrene butadiene rubber which may be either of the so-called no gel or non gelling type. However, it is to be understood that so-called gel type formulations of polymeric foam materials may be employed, if desired.

Figure 10:
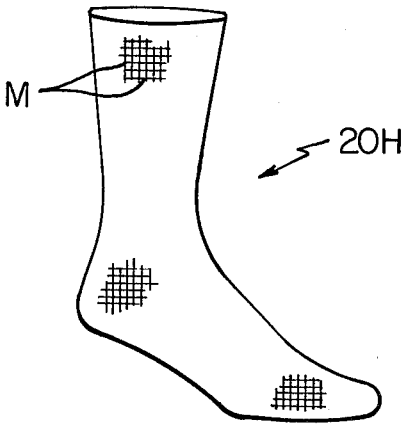
FIG. 10 illustrates another exemplary embodiment of a construction for absorbing odors caused by perspiration in the form of an article of clothing in the form of a sock.

Reference is now made to FIG. 10 of the drawing which illustrates an exemplary embodiment of the construction of this invention in the form of an article of clothing, shown as a sock, which is designated generally by the reference numeral 20H. The sock 20H is comprised of one or more members M of the type described previously and suitable made in accordance with techniques known in the art of making socks. In this example, the entire sock 20H is made of members M; however, it is to be understood that, as is known in the art, only the toe, heel, both toe and heel, or entire sock bottom may be made of members M.

It will also be appreciated that the various fabrics 20 and 20A through 20F may be used to make other garments or articles of clothing such as undergarments, or the like, which are worn against a wearer's body.

In this disclosure of the invention, each member M is described as having carbon disposed homogeneously throughout, in some embodiments, with the carbon being in viscose rayon filaments.

While present exemplary embodiments of this invention, and methods of practicing the same, have been illustrated and described, it will be recognized that this invention may be otherwise variously embodied and practiced within the scope of the following claims.

What is claimed is:

1. A shoe insole for absorbing odors caused by foot perspiration comprising, a fabric having a plurality of members comprising an exposed surface thereof, each of said members comprising an odor-absorbing material, said odor-absorbing material consisting of a carbonaceous material, said members being freely accessible on said exposed surface to said perspiration thereby assuring unimpeded action by the odor-absorbing material thereof, and a substrate fixed against said fabric on the surface thereof opposite from said exposed surface.

2. An insole as set forth in claim 1 in which each of said members is a load-carrying structural member of said fabric and said substrate defines cushion means of said insole.

3. An insole as set forth in claim 2 in which said cushion means comprises a compressible resilient polymeric cushioning pad having air spaces disposed throughout.

4. An insole as set forth in claim 3 in which said pad is made of styrene butadiene latex foam rubber.

5. An insole as set forth in claim 4 and further comprising means fixing said pad against said fabric.

6. An insole as set forth in clim 1 in which said members define the major part of said exposed surface.

7. An insole as set forth in claim 1 in which each of said members has said carbonaceous material disposed in a homogeneous manner throughout as an integral part thereof.

8. An insole as set forth in claim 7 in which each of said members is made of a viscose rayon and has said carbonaceous material disposed throughout.

9. An insole as set forth in claim 1 in which each of said members is made substantially entirely of said carbonaceous material.

10. An insole as set forth in claim 1 in which said carbonaceous material is a structural graphite yarn.

11. An insole as set forth in claim 1 in which said fabric is a non-woven fabric.

12. An insole as set forth in claim 1 in which said members are disposed substantially in parallel relation and stitched together by stitching means disposed substantially transverse said parallel relation.

13. An insole as set forth in claim 1 in which said fabric is a woven fabric comprised of warps and wefts and said members define both said warps and wefts.

14. An insole as set forth in claim 1 in which said fabric is a woven fabric comprised of warps and wefts and said members define only said warps.

15. An insole as set forth in claim 1 in which said fabric is a triaxial fabric.

16. An insole as set forth in claim 1 in which said fabric is a knitted fabric.

17. An insole as set forth in claim 1 in which said members are load-carrying members of said fabric.

18. A method of making a shoe insole for absorbing odors caused by foot perspiration, said method comprising the steps of, providing a plurality of members comprised of an odor-absorbing material, said odor-absorbing material consisting of a carbonaceous material, forming a fabric employing said members such that said members comprise structural members of said fabric and an exposed surface thereof, said members being freely accessible on said exposed surface to said foot perspiration thereby assuring unimpeded action by the odor absorbing material thereof, and fixing a substrate against said fabric on the surface thereof opposite from said exposed surface.

19. A method as set forth in claim 18 in which said fixing step comprises fixing said substrate consisting of cushion means of said insole employing adhesive means between said cushion means and said opposite surface to provide a fixing action.

* * * * *